US006443080B1

(12) United States Patent
Matsumoto et al.

(10) Patent No.: US 6,443,080 B1
(45) Date of Patent: Sep. 3, 2002

(54) PRESSER FOOT SYSTEM FOR SEWING MACHINE

(75) Inventors: Fumio Matsumoto; Yoshiyuki Asazuma; Tohru Seiriki, all of Toyonaka (JP)

(73) Assignee: Yamato Sewing Machine Seizo Co., Ltd., Osaka-Fu (JP)

( * ) Notice: Subject to any disclaimer, the term of this patent is extended or adjusted under 35 U.S.C. 154(b) by 0 days.

(21) Appl. No.: 09/705,992

(22) Filed: Nov. 4, 2000

(30) Foreign Application Priority Data

Nov. 10, 1999 (JP) ..... 11-357843

(51) Int. Cl.[7] ..... D05B 29/08
(52) U.S. Cl. ..... 112/235
(58) Field of Search ..... 112/235, 151, 112/122, 126, 127, 128, 129, 240

(56) References Cited

U.S. PATENT DOCUMENTS 1,697,571 A * 1/1929 Merritt et al. ..... 112/235
2,915,996 A * 12/1959 Charest ..... 112/151 X
5,205,231 A * 4/1993 Sanvito et al. ..... 112/235
5,370,071 A * 12/1994 Ackermann ..... 112/235 X
5,960,729 A * 10/1999 Matsumoto et al. ..... 112/235

* cited by examiner

*Primary Examiner*—Ismael Izaguirre
(74) *Attorney, Agent, or Firm*—D. Peter Hochberg; Katherine R. Vieyra; William H. Holt

(57) ABSTRACT

Provided is a presser foot system for sewing machine comprising a small tubular cylinder bed which is used, for example, in joining crotch sewing of underpants or drawers and joining shoulder sewing of shirts. Distance from the center of a needle location to the cutting starting position of a knife trimming mechanism, wherein the upper edges of the ends of fabrics in a vertical face-to-face contact to be fed to a guide path are cut to an even length, is set to the range of 16.5 mm to 18.0 mm in actual dimension. This range is sufficient so that the ends thus cut by one operation of the knife trimming mechanism are stacked one on another by the operation of guide of upper and lower guides until these reach the needle location. Thus, irrespective of the thickness and flexibility of the fabric material and the presence or absence of a step, the ends of the fabrics cut to the even length can be fed in a predetermined stacked state to the needle location, thereby ensuring high quality finish of sewing.

8 Claims, 7 Drawing Sheets

F I G − 1
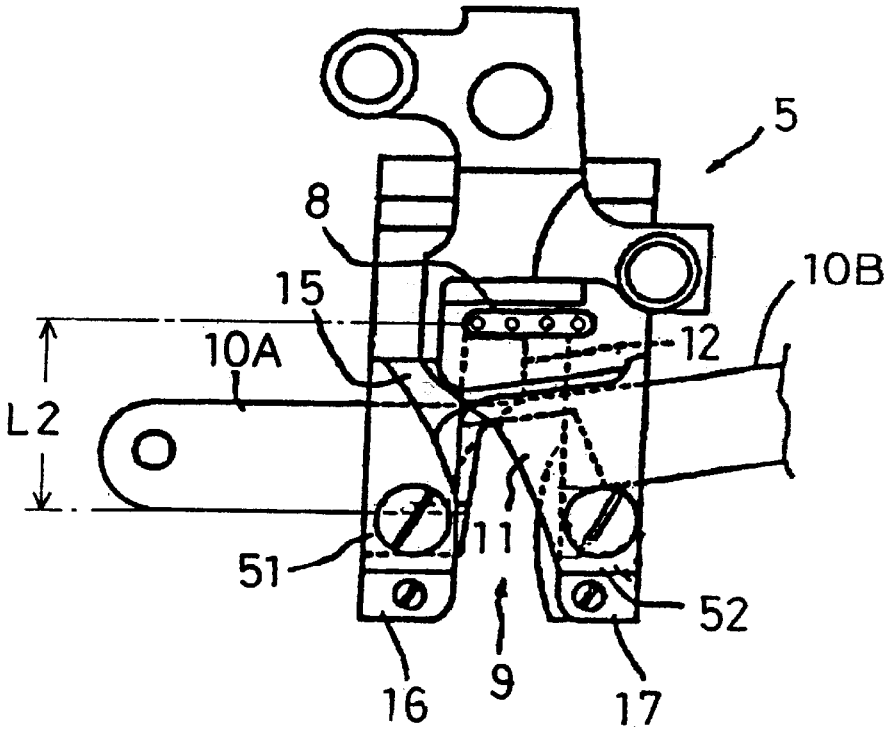
F I G − 2
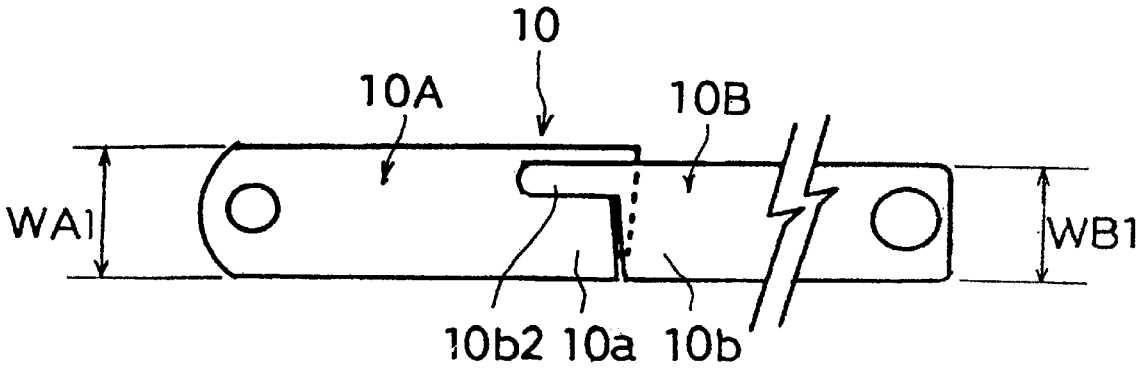

F I G − 5
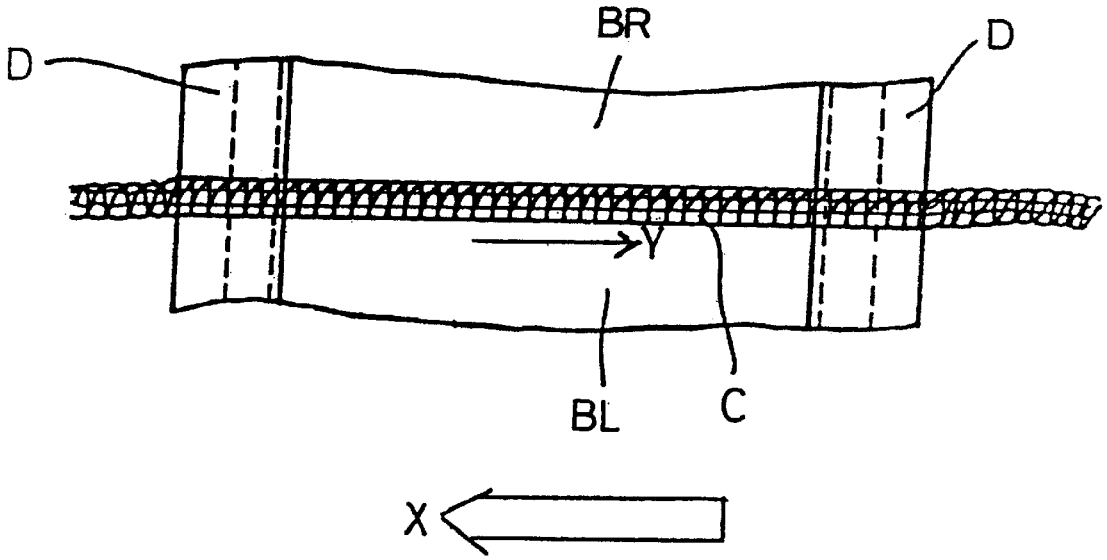
F I G − 6
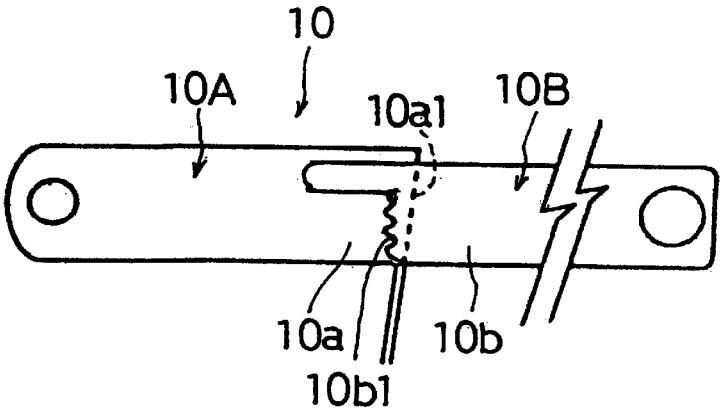

FIG-10A
PRIOR ART
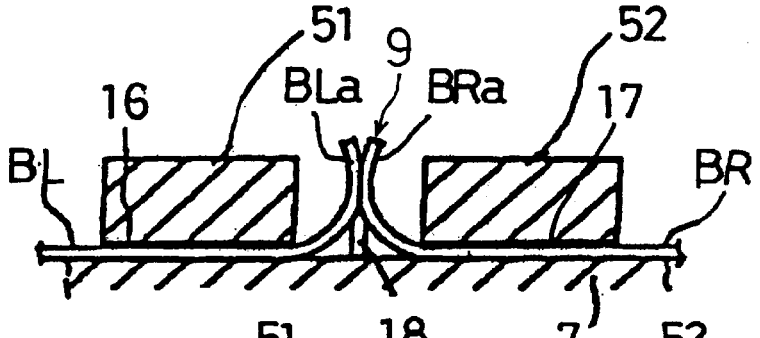
FIG-10B
PRIOR ART
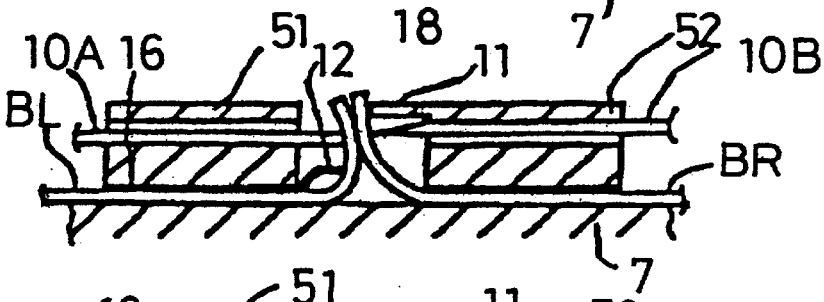
FIG-10C
PRIOR ART
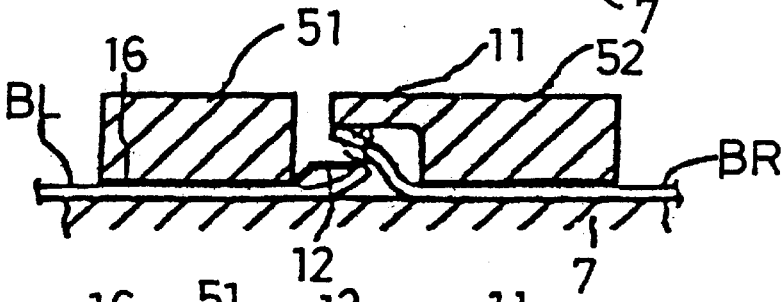
FIG-10D
PRIOR ART
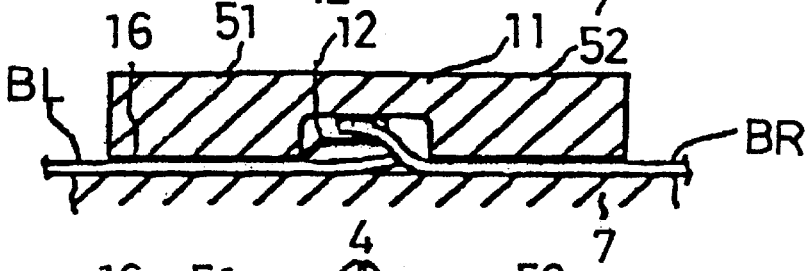
FIF-10E
PRIOR ART
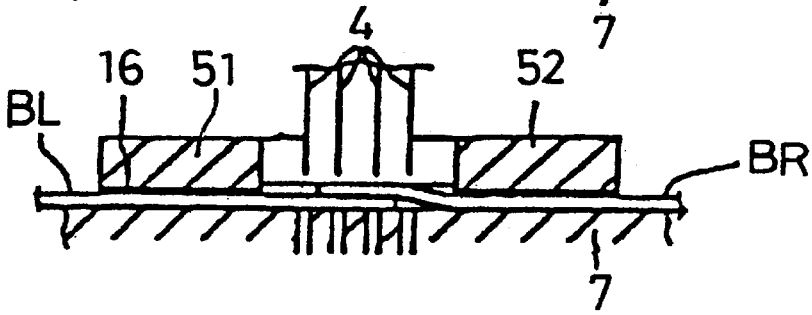

PRESSER FOOT SYSTEM FOR SEWING MACHINE

BACKGROUND OF THE INVENTION

1. Field of the Invention

The present invention generally relates to a presser foot system for sewing machine comprising a small tubular cylinder bed which is used, for example, in joining crotch sewing of underpants or drawers and joining shoulder sewing of shirts. More particularly, the invention relates to a presser foot system mounded on an interlock stitch sewing machine with which the upper edges of the ends of two fabrics to be fed in a vertical face-to-face contact are cut to an even length, and the resulting ends of the fabrics are stacked one on another on a stitch plate and then fed to a needle location for sewing the overlap portions.

2. Description of the Prior Art

When performing a sewing operation wherein the ends of two fabrics cut to a predetermined shape being stacked over a predetermined width are fed to a needle location while sewing the overlap portions, it is necessary to adjust the overlap width of the ends of the fabrics. If the sewing operator performs such adjustment by hand at a location, in the direction of sewing, before a presser foot system in which the fabrics are held and pressed against the stitch plate, a lot of labor and skill are required, resulting in poor operating efficiency. Further, difference in the degree of skill may often cause variations in the finished sewing article.

In order to omit such manual adjustment of the overlap width of two fabrics, that is, to perform such adjustment automatically, a presser foot system for sewing machine has conventionally been proposed and put into practice which has a specific construction and comprises a knife trimming mechanism and a guide means. The knife trimming mechanism cuts the edges of fabrics to be sewed into an even length, and the guide means guides the ends of the fabrics respectively to travel (move) to a needle location in order that these ends cut by the knife trimming mechanism are stacked one on another at a location before the needle location.

FIGS. 7 and 8 illustrate one particular example of known presser foot systems for sewing machine having a specific construction which comprises the above-mentioned knife trimming mechanism and guide means. Specifically, FIG. 7 is a perspective view of the vicinity of a needle location in an interlock stitch sewing machine. A sewing machine arm 1 has at its tip a needle bar (not shown) and a presser bar 2 that are aligned before and after in the sewing direction X and are supported vertically and downwardly. A number of needles 4 are attached via a needle clamp body 3 to the lower end of the needle bar. A presser foot system for sewing machine 5 is fixedly supported to the lower end of the presser bar 2.

The presser foot system 5 comprises (i) a pair of right and left presser feet 51 and 52, as shown in FIG. 8, which are disposed before a needle location 8 of a throat plate 7 fixed on the upper surface of a small tubular cylinder bed 6, so as to be free to make a flexible contact with the throat plate 7, (ii) a fabric guide path 9 that is formed between the opposed surfaces of the presser feet 51, 52 and is opened forward of the sewing direction X, (iii) a knife trimming mechanism 10 disposed in the course of the fabric guide path 9, by which the edge portions of the ends of right and left fabrics BR and BL in a vertical face-to-face contact are fed to the fabric guide path 9, and (iv) a guide means comprising upper and lower guides 11 and 12 which respectively guide the fabrics BR and BL cut to an even length by the knife trimming mechanism 10 to move to the needle location 8, thereby stacking the ends of the fabrics BR and BL.

The knife trimming mechanism 10 is made up of a fixed knife 10A and a movable knife 10B. The fixed knife 10A is fixed to one presser foot 51 with its cutting edge 10*a*1 (see FIG. 9) faced into the fabric guide path 9. The movable knife 10B is disposed on the side of the other presser foot 52 with its cutting edge 10*b*1 (see FIG. 9) faced into the fabric guide path 9. As shown in FIG. 7, the movable knife 10B is urged on its base end downwardly by a coil spring 14 and attached to the lower end of a rod 13 moving with the rotation of a main shaft (not shown) of the sewing machine, and is constructed so as to be free to rock in the directions indicated by arrows a and b crossing the fabric guide path 9. Thereby, the movable knife 10B is brought into a sliding contact in the plane horizontal to the upper surface of the fixed knife 10A by the action of the coil spring 14 that is generated by movement of the rod 13. As shown in FIG. 9, a contact guide piece 10*b*2 for guiding the sliding contact of the knives 10A and 10B is formed at one end of the movable knife 10B in the sewing direction.

The upper surface of the presser foot system 5 is provided with a guide slot 15 that extends from the terminal part of the fabric guide path 9 to an oblique rearward of the sewing direction X, so as to be continuous with the outer edge of the presser foot 51. By the guide slot 15, the ends of the fabrics cut by the knife trimming mechanism 10 are guided to the outside of the presser foot 51 and then discharged, without reaching the needle location 8.

The upper guide 11 of the guide means is disposed above the presser foot 52 and overhangs at its middle part toward the fabric guide path 9. As the upper guide 11 approaches the needle location 8, the amount of overhang toward the fabric guide path 9 is increased so as to be continuous with the upper guide slot 15. The lower guide 12 is disposed under the presser foot 51 and the amount of overhang toward the fabric guide path 9 is increased as it approaches the needle location 8, like the upper guide 11. Also, the lower guide 12 is formed so as to be substantially horizontally opposed to the stitch plate 7 with a predetermined gap therebetween.

In the presser foot system 5, slide plates 16 and 17 are attached to the lower surface of the paired presser feet 51 and 52, respectively, over the entire length in the sewing direction X. The slide plates 16 and 17 ensure slide between the fabrics BR and BL held and urged against the stitch plate 7, thereby facilitating the fabric feed operation of feed dogs (not shown). The lower guide 12 is integrally formed with the slide plate 16 on the side of the presser foot 51.

Operation to cut the ends of fabrics to an even length and to stack one on another performed by the presser foot system 5 so constructed will be described by referring to FIGS. 10A to 10E.

As shown in FIG. 10A, right and left fabrics BR and BL are fed to the fabric guide path 9 in such a state that their ends BRa and BLa having a predetermined width are stacked one on another. At this time, an auxiliary bar 18 may be used to hold the vertical state of the overlap portions of the fabrics BR and BL.

As shown in FIG. 10B, when the fabrics BR and BL fed in this state into the fabric guide path 9 reach the knife trimming mechanism 10, the movable knife 10B rocks in a direction to cross the fabric guide path 9 such that it is brought into sliding contact with the upper surface of the fixed knife 10A within a horizontal plane. Thereby, the upper edges of the ends of the fabrics BR and BL are cut to an even length. In this cutting position, the upper and lower guides 11 and 12 overhang in a predetermined amount within the fabric guide path 9. The end face of the upper guide 11 is in contact with the outer surface of the end of the resulting right fabric BR, and the end face of the lower guide 12 is in contact with the outer surface of the end of the resulting left fabric BL.

As shown in FIGS. 10C and 10D, as the left fabric BL of which upper edge is cut by the knife trimming mechanism 10 is fed in the sewing direction X, it is brought down to the stitch plate 7 when it is pushed from the left by the lower guide 12 in which the amount of overhang is increased as it approaches the needle location 8. On the other hand, the right fabric BR is pushed from the right by the upper guide 11 and is guided between the upper guide 11 and the underlying lower guide 12. Then it reaches the terminal end of the lower guide 12 and overlies the end of the left fabric BL lying on the stitch plate 7. The right and left fabrics BR and BL in such a stacked state are fed to the needle location 8 and the overlap portions are sewed by the needle 4 going down to the needle location 8, as shown in FIG. 10E.

In the conventional presser foot system for sewing machine comprising the above-mentioned knife trimming mechanism and guide means and performing the above-mentioned sewing operation, distance L1 from the center of the needle location 8 to the front end of the fixed knife 10A of the knife trimming mechanism 10 in the sewing direction X, namely to the position from which the knife trimming mechanism 10 starts to cut the fabrics to an even length, is set to 16.0 mm in actual dimension, as shown in FIG. 8. In FIG. 11, CW denotes one cutting width obtained by the knife trimming mechanism 10 that operates one time for each stitch motion of the needle 4 (i.e., one up and down motion), and H denotes the height from the upper surface of the stitch plate 7 to the cutting position (i.e., the lower surface of the fixed knife 10A). The distance L1 is set according to distance L needed in bringing down the ends of fabrics. The distance L is calculated by trigonometric function from the known values of the cutting width CW and height H, in order that the ends of the right and left fabrics BR and BL cut in a vertical state to an even length are stacked one on another on the stitch plate 7 until these reach the needle location 8.

However, the cutting width CW obtained by the knife trimming mechanism 10 varies depending on the thickness and flexibility of the fabric material. There is also height H variation because due to manufacturing tolerance inherent in each sewing machine, some difference in altitude may occur in the setting position of the fixed knife 10A and movable knife 10B of the knife trimming mechanism 10. In particular, when performing joining crotch sewing of underpants or drawers, a thick stage D is present at the initiation and termination of sewing, as shown in FIG. 12. Therefore, the cutting width CW and height H are smaller than that in other portions, and such cutting width CW and height H variations may cause the event that the ends of the right and left fabrics BR and BL cut to an even length cannot be brought down completely within the distance L set in the above manner.

Thus, in the conventional presser foot system for sewing machine in which the distance from the center of the needle location 8 to the cutting position of the knife trimming mechanism 10 is set to L1 (16.0 mm in actual dimension), there are the following problems. That is, if the ends of the right and left fabrics BR and BL are brought down incompletely, the ends of the fabrics BR and BL cut to an even length cannot be stacked in a predetermined state and fed to the needle location 8 for sewing. As a result, a seam C includes a projected portion C1 toward a seam direction Y (which is reverse of the sewing direction X) formed at the stage D of the initiation and termination of sewing, as shown in FIG. 12. This results in poor finish of the sewing article.

In addition, when the cutting quality of the knife trimming mechanism 10 is lowered for a long-term use, the cutting width CW may vary to cause such poor finish as above described, even if the thickness and flexibility of the fabric material are the same.

SUMMARY OF THE INVENTION

It is therefore an object of the present invention to overcome the foregoing drawbacks by providing a presser foot system for sewing machine in which the ends of two fabrics cut to an even length are fed in a predetermined stacked state to a needle location thereby sewing is always performed with high quality finish.

According to a first aspect of the invention, a presser foot system for sewing machine, comprising: a pair of presser feet disposed before a needle location to allow for flexible contact with a throat plate; a knife trimming mechanism disposed in the course of a fabric guide path formed between the opposed surfaces of the presser feet, with which the upper edges of the ends of fabrics in a vertical face-to-face contact to be fed to the fabric guide path are cut to an even length by using sliding contact in a horizontal plane between a fixed knife and a movable knife; and upper and lower guides with which movement of the end of one of the fabrics cut to the even length by the knife trimming mechanism and movement of the end of the other are guided respectively to stack one on another on the stitch plate, wherein, the distance from the center of the needle location to a cutting starting position of the knife trimming mechanism is set to a sufficient value so that the ends of the fabrics cut to the even length by one operation of the knife trimming mechanism are stacked one on another until these reach the needle location.

According to a second aspect of the invention, the presser foot system for sewing machine according to the first aspect is characterized in that the distance from the center of the needle location to the cutting starting position of the knife trimming mechanism is set to the range of 16.5 mm to 18.0 mm.

With the first or second aspect, the edges of the fabrics cut to an even length in their vertical position can be brought down completely until these reach the needle location and then fed to the needle location in a predetermined stacked state, even when the cutting width for each operation of the knife trimming mechanism varies depending on the thickness and flexibility of the fabric material, and when the height from the upper surface of the stitch plate to the cutting position varies somewhat due to difference in altitude of the setting position of the fixed knife and movable knife in the knife trimming mechanism inherent in each sewing machine, and further, when a thick stage is present at the initiation and termination of sewing. Therefore, such a poor finish that a projected portion toward a seam direction is formed at a location of the initiation and termination of sewing can be prevented to permit a sewing article exhibiting high quality finish over the entire length.

In the presser foot system for sewing machine according to the first or second aspect, as a means for setting the distance from the center of the needle location to the cutting starting position of the knife trimming mechanism, it can be considered to shift a knife trimming mechanism having the same cutting width as the conventional one to the reverse direction of the sewing direction. In this case, however, the upper and lower guides to guide movement of the ends of fabrics cut to an even length should be improved as a whole in the guide start position and the amount of overhang toward the fabric guide path. This results in a complicated structure.

According to a third or fourth aspect of the invention, there is provided a means for increasing the cutting width of the movable knife and fixed knife in the knife trimming mechanism. This case requires no improvement of the upper and lower guides, resulting in a simple structure.

According to a fifth aspect of the invention, the means for increasing the cutting width of the movable knife and fixed knife in the knife trimming mechanism is one selected from the group consisting of: a means for increasing the ratio of the width of the blade part to the width of the sliding contact guide piece in the movable knife; a means for increasing the entire width of the movable knife while the ratio of the width of the blade part to the width of the sliding contact guide piece in the movable knife is held constant; and a means for increasing the entire width of the movable knife and increasing the width of the blade part to the width of the sliding contact guide piece.

According to a sixth aspect of the invention, a presser foot system for sewing machine, comprising: a pair of presser feet disposed before a needle location to allow for flexible contact with a throat plate; a knife trimming mechanism disposed in the course of a fabric guide path formed between the opposed surfaces of the presser feet, with which the upper edges of the ends of fabrics in a vertical face-to-face contact to be fed to the fabric guide path are cut to an even length by using sliding contact in a horizontal plane between a fixed knife and a movable knife; and upper and lower guides with which movement of the end of one of the fabrics cut to the even length by the knife trimming mechanism and movement of the end of the other are guided respectively to stack one on another on the stitch plate, wherein, a cutting edge of a blade part of the movable knife or fixed knife in the knife trimming mechanism is corrugated and a cutting edge of the corresponding fixed knife or movable knife is formed linearly.

With the construction of the sixth aspect, since the movable knife or fixed knife of the knife trimming mechanism has the corrugated cutting edge, its cutting quality is superior to that of the linear cutting edge, and the function of cutting at a predetermined cutting width is ensured even for very thick fabrics, without causing remainder. That is, the cutting width obtained by one operation of the knife trimming mechanism (indicated by "CW" in FIG. 12) is stabilized, and the ends of the fabrics cut to an even length can be brought down completely until these reach the needle location and then fed in a predetermined stacked state to the needle location. Therefore, even for very thick fabrics, it is able to prevent such a poor finish that a projected portion toward a seam direction is formed at a location of the initiation and termination of sewing. This ensures a sewing article that exhibits high quality finish over the entire length.

According to a seventh or eighth aspect of the invention, the presser foot system for sewing machine according to the sixth aspect is characterized by using hard metal or ceramics for the movable or fixed knife of which cutting edge is corrugated.

With this construction, the anti-wear characteristics and durability of the knife having the corrugated cutting edge can be increased, and the knife trimming mechanism can maintain excellent cutting quality as a whole for a long period of time, by polishing only the other knife having the linear cutting edge.

These and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a plan view of a presser foot system for sewing machine according to the present invention.

FIG. 2 is a plan view illustrating an important part of a presser foot system for sewing machine according to one preferred embodiment of the invention.

FIG. 5 is an enlarged plan view illustrating an important part of the finished state of a sewing article obtained by a presser foot system for sewing machine according to the invention.

FIG. 6 is a plan view of an important part of a presser foot system for sewing machine according to the invention.

FIGS. 10A to 10E are enlarged front views of an important part illustrating in sequence the operation of a conventional presser foot system for sewing machine, through which the ends of fabrics are cut to an even length and stacked one on another.

DESCRIPTION OF THE PREFERRED EMBODIMENT

Preferred embodiments of the present invention will be described by referring to the accompanying drawings.

Figure 7:
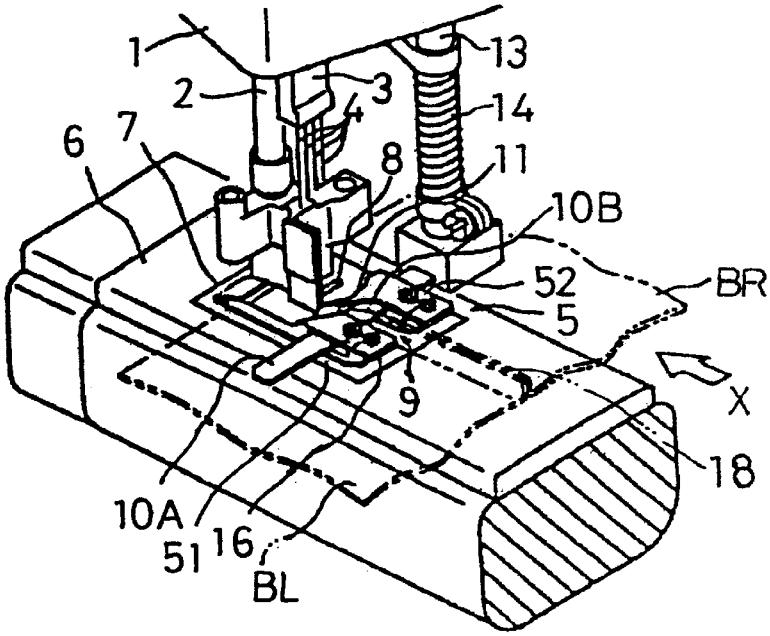
FIG. 7 is a perspective view of the vicinity of a needle location of an interlock stitch sewing machine equipped with a presser foot system.
Figure 8:
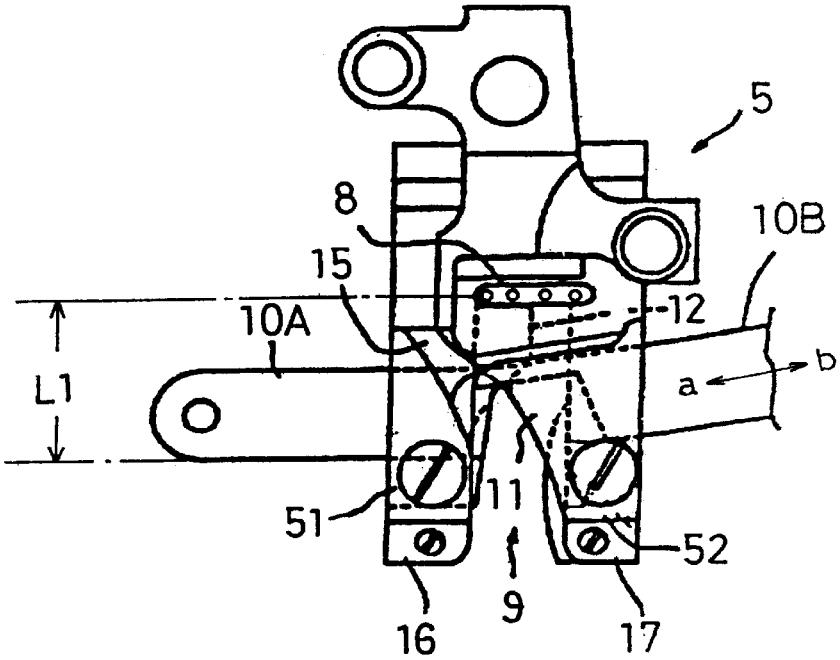
FIG-8 PRIOR ART
FIG. 8 is a plan view of a conventional presser foot system for sewing machine.

FIG. 1 is a plan view of a presser foot system for sewing machine according to the invention. The entire construction of the vicinity of a needle location in an interlock stitch sewing machine equipped with this presser foot system is the same as that shown in FIG. 7, and description and diagram thereof are thus omitted here. In FIG. 1, the same references have been used as in FIG. 8 for similar components or parts, and detailed description as to construction and fiction are omitted here. Therefore, the following description will mainly be made of points different from conventional ones.

In a presser foot system for sewing machine 5 in FIG. 1, distance L2 from the center of a needle location 8 to the cutting starting position of a knife trimming mechanism 10 made up of a fixed knife 10A and a movable knife 10B, is set to a sufficient value, namely in the range of 16.5 mm to 18.0 mm in actual dimension, so that the ends of right and left fabrics BR and BL cut to an even length by one operation of the knife trimming mechanism 10 are stacked one on another until these reach the needle location 8.

As a means for setting the distance L2 (in the range of 16.5 mm to 18.0 mm), there is adopted a means for increasing the cutting width by means of a blade part 10*a* of the fixed knife 10A and a blade part 10*b* of the movable knife 10B in the knife trimming mechanism 10. Specifically, the following three means can be considered.

Figure 3:
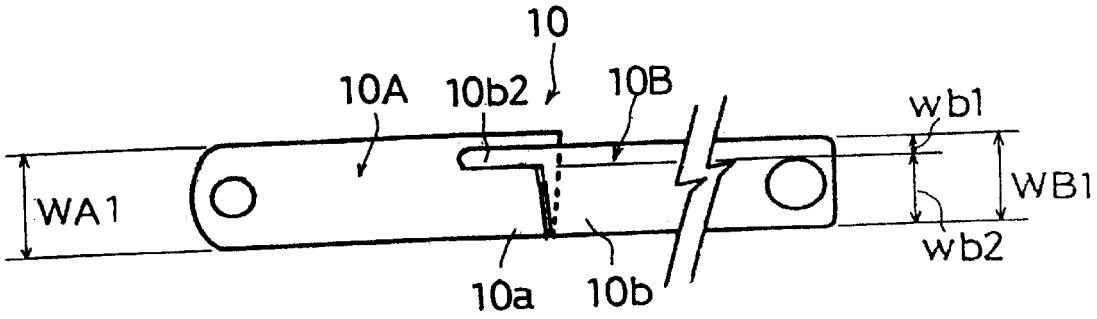
FIG. 3 is a plan view illustrating an important part of a presser foot system for sewing machine according to other preferred embodiment of the invention.
Figure 4:
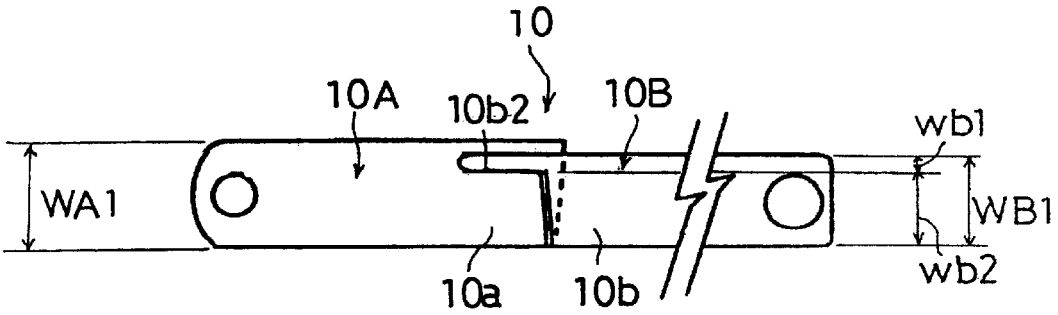
FIG. 4 is a plan view illustrating an important part of a presser foot system for sewing machine according to other preferred embodiment of the invention.
Figure 9:
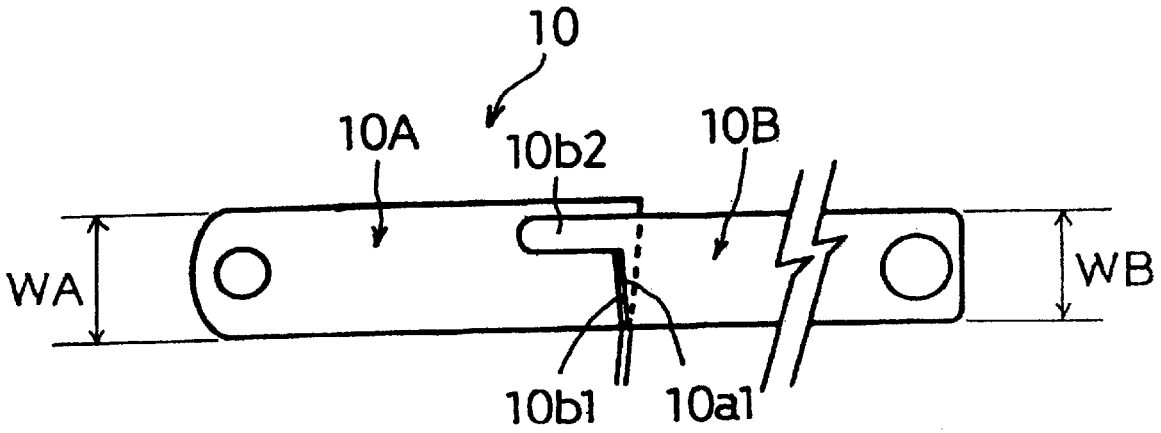
F I G – 9 PRIOR ART
FIG. 9 is a plan view illustrating an important part of a conventional presser foot system for sewing machine.

(I) As shown in FIG. 2, the entire width WA1 of the fixed knife 10A is set to 9.1 mm, which is greater than 7.8 mm that is set as the entire width WA of the conventional fixed knife 10A shown in FIG. 9, (WA1>WA), and the entire width WB1 of the movable knife 10B is set to 8.4 mm, which is greater than 7.1 mm that is set as the entire width WB of the conventional movable knife 10B in FIG. 9, (WB1>WB);

(II) As shown in FIG. 3, the ratio of width wb2 of a blade part 10*b* to width wb1 of a sliding contact guide piece 10*b*2 in the movable knife 10B, (wb2/wb1), is increased while the entire width WA1 of the fixed knife 10A and the entire width WB1 of the movable knife 10B are set to 7.8 mm and 7.1 mm, respectively, which are the same as the entire width WA of the conventional fixed knife 10A and the entire width WB of the conventional movable knife 10B shown in FIG. 9, (WA1=WA, WB1=WB); and (III) As shown in FIG. 4, (i) the entire width WA1 of the fixed knife 10A is set to 9.1 mm, which is greater than 7.8 mm that is set as the entire width WA of the conventional fixed knife 10A shown in FIG. 9, (WA1>WA), (ii) the entire width WB1 of the movable knife 10B is set to 8.4 mm, which is greater than 7.1 mm that is set as the entire width WB of the conventional movable knife 10B in FIG. 9, (WB1>WB), and (iii) the ratio of width wb2 of the blade part 10*b* to the width wb1 of the sliding contact guide piece 10*b*2 in the movable knife 10B, (wb2/wb1), is increased.

The operation to cut the ends of fabrics to an even length and to stack one on another performed by the presser foot system for sewing machine 5 so constructed is basically identical with that described by referring to FIGS. 10A to 10E.

Figure 11:
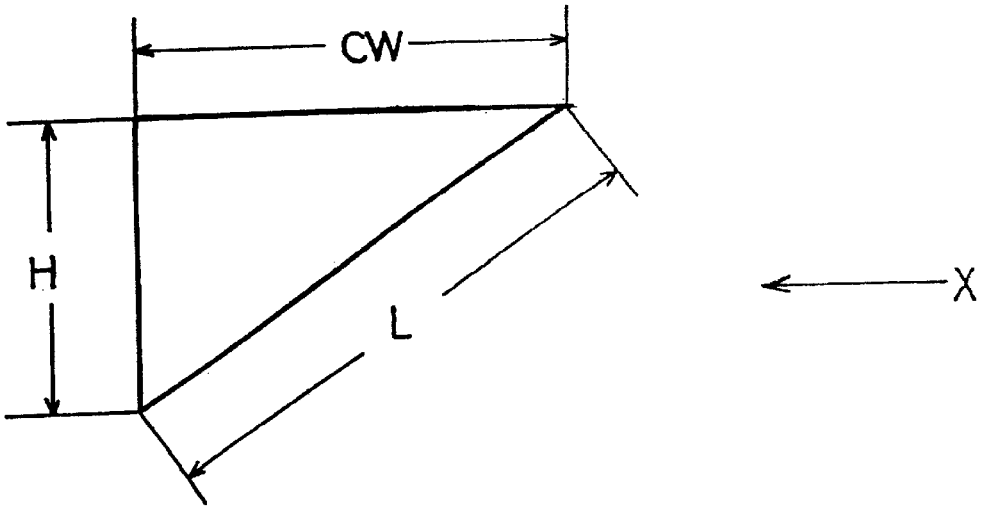
FIG-11 PRIOR ART
FIG. 11 is a diagram illustrating a means for setting the distance from the center of a needle location to the cutting starting position of a knife trimming mechanism in a conventional presser foot system for sewing machine.
Figure 12:
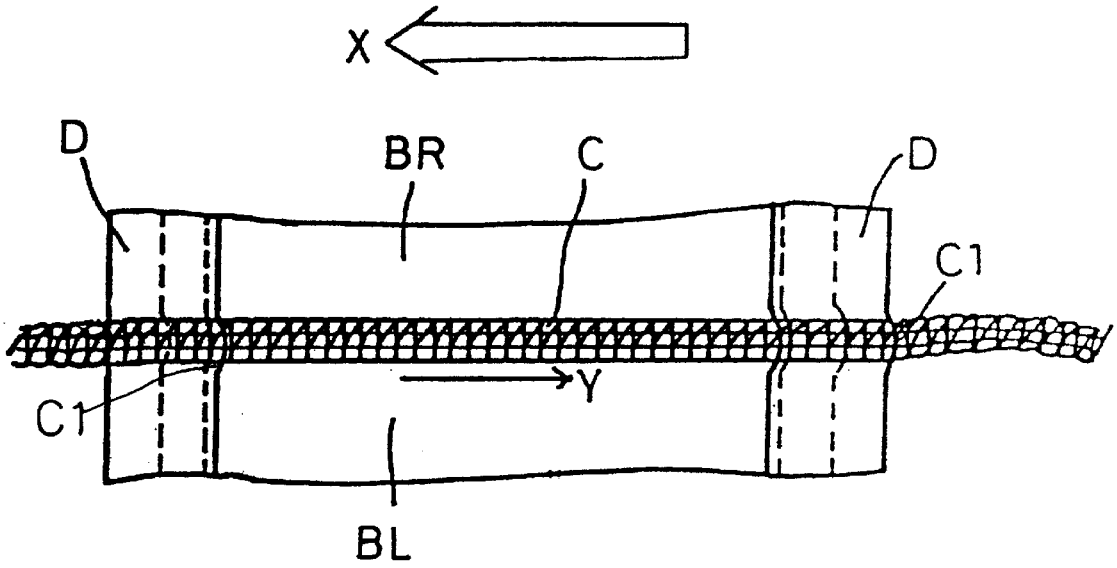
FIG-12 PRIOR ART
FIG. 12 is an enlarged plan view of an important part of the finished state of a sewing article obtained by a conventional presser foot system for sewing machine.

As stated above, the distance L2 is set to a sufficient value, i.e., in the range of 16.5 mm to 18.0 mm in actual dimension, so that the ends of right and left fabrics BR and BL cut to an even length by one operation of the knife trimming mechanism 10 can be stacked one on another until these reach the needle location 8. Therefore, the ends of the fabrics BR and BL cut to an even length by the knife trimming mechanism 10 are brought down completely until these reach the needle location 8 and then fed in a predetermined stacked state to the needle location 8, even when the cutting width CW for each operation of the knife trimming mechanism 10 varies somewhat depending on the thickness and flexibility of the fabric material (see FIG. 11), and when the height H (see FIG. 11) from the upper surface of the stitch plate 7 to the cutting position varies somewhat due to difference in altitude of the setting position of the fixed knife 10A and movable knife 10B of the knife trimming mechanism 10 inherent in each sewing machine, and further, when a thick stage D is present at the initiation and termination of sewing. Thereby, as shown in FIG. 5, a sewing article of high quality finish having a linear seam C can be obtained without forming any projected portion toward the seam direction Y at a location of the initiation and termination of sewing.

FIG. 6 is a plan view illustrating an important part of a presser foot system for sewing machine according to the invention. The movable knife 10B of the knife trimming mechanism 10 is formed from hard metal or ceramics, and the cutting edge 10*b*1 of the blade part 10*b* of the movable knife 10B is corrugated. The cutting edge 10*a*1 of the blade part 10*a* of the fixed knife 10A is formed linearly. Otherwise, the construction is identical to that described with respect to FIG. 1. The operation to cut the ends of fabrics to an even length and to stack one on another is also identical to that described with respect to FIGS. 10A to 10D. Thus, description thereof is omitted here.

In the presser foot system for sewing machine shown in FIG. 6, the corrugated cutting edge 10*b*1 of the blade part 10*b* exhibits cutting quality superior to that obtainable by a linear one, and can function to cut with a predetermined cutting width CW even for very thick fabrics, without causing remainder. That is, the cutting width CW obtained by one operation of the knife trimming mechanism 10 is stabilized and the ends of the fabrics cut to an even length are brought down completely until these reach the needle location 8 and then fed in a predetermined stacked state to the needle location 8. Thus, even for very thick fabrics, it is able to prevent such a poor finish that a projected portion toward the seam direction is formed at a location of the initiation and termination of sewing.

In addition, since the movable knife 10B provided with the corrugated cutting edge 10*b*1 is formed from hard metal or ceramics, the anti-wear characteristics and durability of the movable knife 10B can be increased, and the knife trimming mechanism 10 can maintain excellent cutting quality as a whole for a long period of time, by polishing only the fixed knife 10A having the linear cutting edge 10*a*1.

Although in the foregoing description the cutting edge 10*b*1 of the blade part 10*b* of the movable knife 10B is corrugated, it is also possible to construct such that the cutting edge 10*a*1 of the blade part 10*a* of the fixed knife 10A is corrugated and the cutting edge 10*b*1 of the blade part 10*b* of the movable knife 10B is formed linearly. This construction also permits excellent cutting quality as above described.

While the invention has been described in detail, the foregoing description is in all aspects illustrative and not restrictive. It is therefore understood that numerous modifications and variations can be devised without departing from the scope of the invention.

What is claimed is:

1. A presser foot system for sewing machine, comprising:

a pair of presser feet disposed before a needle location to allow for flexible contact with a throat plate;

a knife trimming mechanism disposed in the course of a fabric guide path formed between the opposed surfaces of said presser feet, with which the upper edges of the ends of fabrics in a vertical face-to-face contact to be fed to said fabric guide path are cut to an even length by using sliding contact in a horizontal plane between a fixed knife and a movable knife; and upper and lower guides with which movement of the end of one of said fabrics cut to the even length by said knife trimming mechanism and movement of the end of the other are guided respectively to stack one on another on said throat plate, wherein, said knife trimming mechanism is movable to control a distance from the center of said needle location to a cutting starting position of said knife trimming mechanism said distance being at least of a sufficient value for the ends of said fabrics cut to the even length by one operation of said knife trimming mechanism when stacked one on another to reach said needle location; and further including apparatus for setting said distance, said apparatus having the fixed knife having a width of 9.1 mm and the movable knife having a width of 8.4 mm.

2. The presser foot system for sewing machine according to claim 1 wherein said distance is in the range of 16.5 mm to 18.0 mm.

3. The presser foot system for sewing machine according to claim 1, said apparatus further including the movable knife having a blade part having a width, a sliding contact guide piece having a width and a ratio of the width of said blade part to said guide piece and said apparatus being selected from the group consisting of: (i) increasing the ratio of the width of said blade part to the width of said guide piece; (ii) increasing the width of said movable knife while the ratio of the width between said blade part and said guide piece is held constant; and (iii) increasing the width of said movable knife and increasing the ratio of the width of said blade part to the width of said guide piece.

4. A presser foot system for sewing machine, comprising:

a pair of presser feet disposed before a needle location to allow for flexible contact with a throat plate;

a knife trimming mechanism disposed in the course of a fabric guide path formed between the opposed surfaces of said presser feet, with which the upper edges of the ends of fabrics in a vertical face-to-face contact to be fed to said fabric guide path are cut to an even length by using sliding contact in a horizontal plane between a fixed knife and a movable knife; and upper and lower guides with which movement of the end of one of said fabrics cut to the even length by said knife trimming mechanism and movement of the end of the other are guided respectively to stack one on another on said stitch plate, wherein, a cutting edge of a blade part of said movable knife or said fixed knife in said knife trimming mechanism is corrugated and a cutting edge of the corresponding fixed knife or movable knife is formed linearly.

5. The presser foot system for sewing machine according to claim 4 wherein said movable knife or fixed knife having said cutting edge to be corrugated is formed from hard metal.

6. The presser foot system for sewing machine according to claim 4 wherein said movable knife or fixed knife having said cutting edge to be corrugated is formed from ceramics.

7. An improved presser foot system for a sewing machine over a prior presser foot system, the prior presser foot system having:

a prior fixed knife having:

an entire width WA;

a cutting blade at a forward end of the prior fixed knife;

a prior movable knife, movable in generally linear direction with respect to the prior fixed knife, the prior movable knife having:

an entire width WB;

a cutting blade opposite the cutting blade of the fixed knife for cooperating with the latter cutting blade to cut fabric when the prior movable knife is moved towards the prior fixed knife;

a prior sliding contact guide piece having a front edge and a back edge, the width from the back edge to the front edge being wb2', the width from the front edge of the prior sliding contact guide piece to the front edge of the prior movable knife being wb1';

said improved presser foot system having an improved knife trimming mechanism comprising:

an improved fixed knife having:

an entire width WA1;

an improved movable knife having an entire width WB1 and a front edge; and an improved sliding contact guide piece having a front edge and a back edge, the width from the back edge to the front edge being wb2, the width from the front edge of the improved sliding contact guide piece to the front edge of the improved movable knife being wb1;

improved knife trimming mechanism having the characteristics of one of the following criteria:

(I) the entire width of the improved fixed knife being related to the entire width of the prior fixed knife as follows: WA1>WA and the entire width of the improved movable knife being related to the entire width of the prior movable knife as follows: WB1>WB;

(II) the prior ratio of the width from the width of the back edge to the front edge of the prior sliding contact guide piece to the front edge of the prior sliding contact guide piece to the front edge of the prior movable knife is wb2'/wb1' and the improved ratio of the width from the width of the back edge to the front edge of the improved sliding contact guide piece to the front edge of the improved sliding contact guide piece to the front edge of the improved movable knife is wb2/wb1 while the following relationship is as follows:

WA1=WA;

WB1=WB; and (III) the components have the following relationships:

(i) WA1>WA (ii) WB1>WB, and (iii) the value of wb2/wb1 is increased over that set for the criteria of (I) and (II).

8. An improved presser foot system for a sewing machine according to claim 7 wherein said entire width WA1 of said improved fixed knife is 9.1 mm and said entire width WB1 of said improved movable knife is 8.4 mm.

* * * * *